United States Patent [19]

Reinholz

[11] 4,174,108

[45] Nov. 13, 1979

[54] ADJUSTABLE GOLF PUTTER

[76] Inventor: Orville A. Reinholz, 4899 Campbell Ave., Apt. #2, San Jose, Calif. 95130

[21] Appl. No.: 900,604

[22] Filed: Apr. 27, 1978

[51] Int. Cl.[2] ..... A63B 53/06

[52] U.S. Cl. ..... 273/79; 273/168

[58] Field of Search ..... 273/79, 80.1, 80 C, 273/80.2, 167 G, 168

[56] References Cited

U.S. PATENT DOCUMENTS

| | | | |
|---|---|---|---|
| 1,599,336 | 9/1926 | Lindgren | 273/168 X |
| 1,643,250 | 9/1927 | Longsworth | 273/168 X |
| 1,697,846 | 1/1929 | Anderson | 273/79 X |
| 2,138,294 | 11/1938 | Douglas | 273/79 |
| 2,179,034 | 11/1939 | Duncan | 273/79 |
| 2,336,405 | 12/1943 | Kent | 273/168 X |
| 2,530,446 | 11/1950 | Beardsley | 273/79 |
| 3,204,962 | 9/1965 | McCormick | 273/168 X |
| 3,206,206 | 9/1965 | Santosuosso | 273/80.1 |
| 3,423,089 | 1/1969 | Andis | 273/80.1 |
| 3,601,399 | 8/1971 | Agens | 273/79 |

FOREIGN PATENT DOCUMENTS

| | | | |
|---|---|---|---|
| 9169 | of 1908 | United Kingdom | 273/168 |

*Primary Examiner*—Richard J. Apley
*Attorney, Agent, or Firm*—Gerald L. Moore

[57] ABSTRACT

A golf putter having a spring-loaded rotatable head with hitting faces on opposite sides having different pitches so the player can select the pitch most suitable for putting around the golf green.

7 Claims, 6 Drawing Figures

ADJUSTABLE GOLF PUTTER

BACKGROUND OF THE INVENTION

In putting a golf ball the golfer utilizes a putter having a ball contacting face which is positioned substantially vertical when the club is in position to address or strike the ball. This type of club is used most effectively when the ball is on the green, that is, on the short grass surrounding the golf hole. When the ball is on the fairway in longer grass, a pitching wedge is usually used to loft the ball across the higher grass area and land it with backspin on the green. The backspin causes the ball to stop and the lofting negates any need for the ball to roll through the long grass.

Frequently the ball comes to rest in the intermediate height grass extending between the green or in the fairway grass close to the green. This intermediate grass area sometimes is referred to as frog hair. With the ball resting in this area or in the immediately adjacent fairway grass, the golfer is faced with the decision of whether to attempt to putt the ball through the longer grass or use a pitching iron to lift the ball for a short distance. It is the purpose of the present invention to provide a putter which in one configuration will provide a slight lift on the ball to propel it a short distance through or over the grass prior to reaching the green. In another configuration the club may be used as a standard putter.

SUMMARY OF THE INVENTION

A golf putter having a head with faces on each side having different pitch angles. The head is rotatably mounted on the shaft and spring-loaded such that by pulling on the head in a direction to normally separate it from the shaft, the head is partially disengaged so as to allow rotation relative to the shaft. In this manner the putter head configuration can be chosen for either putting or pitching the ball in the vicinity of the green.

DESCRIPTION OF THE INVENTION

Figure 1:
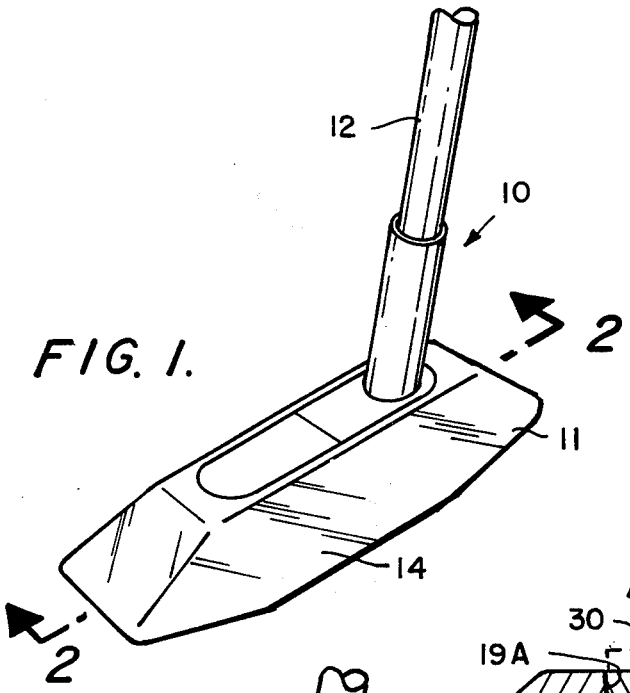
FIG. 1 is a perspective view of a golf putter head embodying the present invention.

Shown in FIG. 1 is a golf club 10 comprising a putter head 11 attached to a shaft 12. Only a partial view of the shaft is shown since it naturally extends upward to a position where it can be grasped by the hands (not shown) for swinging the head to strike and propel a golf ball across the ground.

Figure 5:
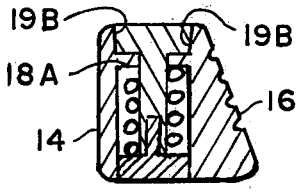
FIG. 5 is a cross-sectional view along the line 5—5 of FIG. 4.
Figure 4:
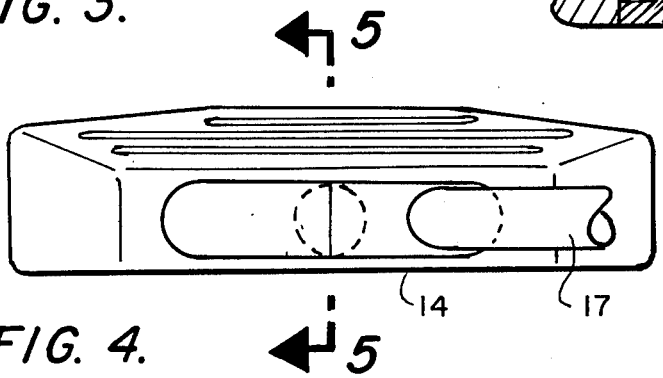
FIG. 4 is a top view of the putter head.

The putter head 11 has a standard face 14 (see FIGS. 1, 4 and 5) which lies in a plane extending substantially parallel to the shaft 12 in the normal manner of a putter face. In other words when the club is placed in position to address a golf ball, the face 14 extends substantially vertical to the ground and in a direction perpendicular to the direction it is desired to hit the ball. With the club face having a zero pitch angle in the manner shown, a slight forward roll is imparted on the hit ball for inducing a proper roll across the green. Usually such club heads are made of brass or a brass alloy which is solid enough to give the club head sufficient weight to impart a motion on the ball and carry it through the ball position during the putting stroke.

Frequently the ball comes to rest on the fairway very close to the green or in the short grass or frog hair surrounding the green. From this position it is sometimes desirable to lift the ball slightly to carry it through or over a short expanse of longer grass adjacent the green in a manner such that the ball will land on the green and roll towards the hole. However the golfer is faced with the dilemma of using either a putter which imparts little or no lift on the ball or utilizing a lofted club having a pitched face angle or striking surface which will readily lift the ball over the short distance but also impart a substantial reverse spin on the ball which may cause the ball to roll eradically across the green. It is difficult to judge either the direction or distance of the ball roll because of this reverse spin. An alternative club selection for this purpose might be a five-iron which imparts a slight lifting of the ball without a severe backspin. However because a five-iron is normally utilized in the fairway, the shaft is longer thereby making it more difficult to use for short shots.

Thus the golfer is left with a difficult choice of clubs for the shot in the adjacent vicinity of the green. In the past attempts have been made to simplify this choice by making clubs which were adjustable in face pitch so the golfer could select a head with a different pitch. However such clubs have frequently been cumbersome in design or have been difficult to adjust thereby making such adjustment a time-consuming process. Naturally the last thing that a golfer about to make a close in-shot needs, is to have to be concerned unduly about adjusting a golf club. The primary purpose of the present invention is to provide a golf club which is adjustable for the purposes previously described and wherein such adjustment is made easily and simply in a single motion.

Figure 2:
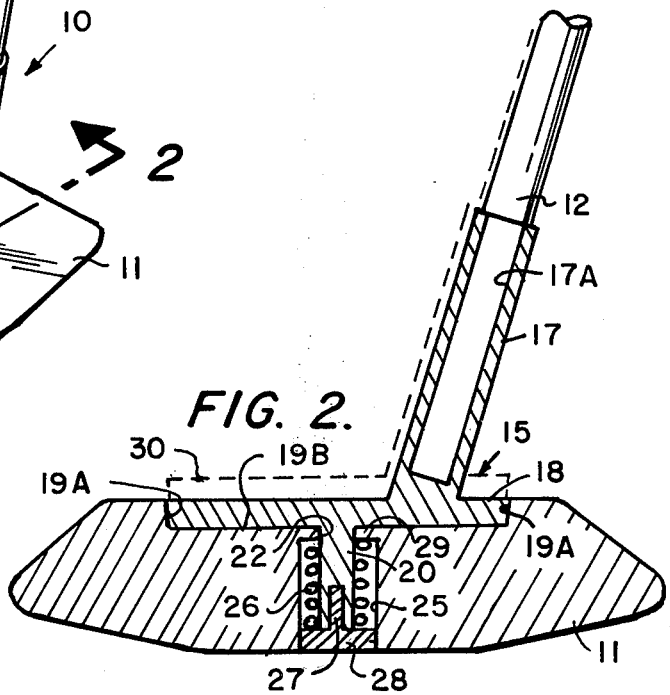
FIG. 2 is a cross-sectional view along the line 2—2 of FIG. 1.
Figure 6:
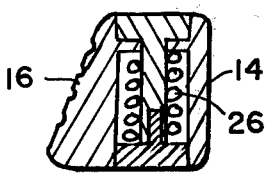
FIG. 6 is the same view as FIG. 5 with the putter head rotated relative to the shaft.

Accordingly as shown primarily in FIG. 2, the shaft 12 is fixed to the putting head 11 by means of an assembly 15 which permits rotation of the head to one of two positions. The head is locked in either of these selected positions so that the putting face 14 is in position for putting or a lofted or pitched face 16 is in the position shown in FIG. 6 for providing a slight loft on the ball for the reasons previously described.

Figure 3:
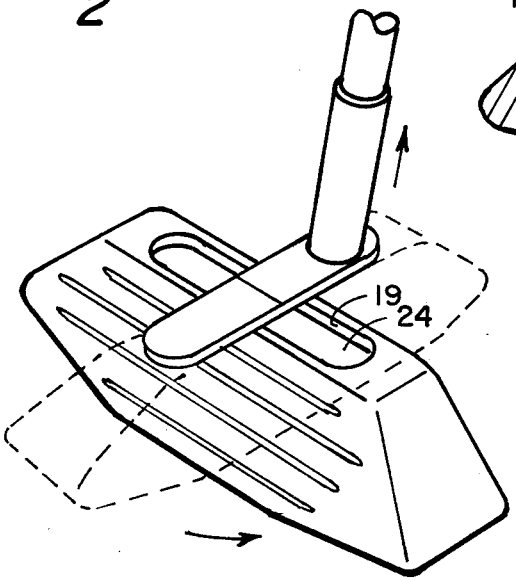
FIG. 3 shows the manner in which the putter head is rotated relative to the club shaft.

To accomplish this the shaft 12 is fixed within a center opening 17A of the sleeve 17. Preferably the shaft is machined to a slightly smaller diameter for this purpose as shown in FIG. 2. Fixed to the bottom of this sleeve is a right angularly disposed plate or detent 18 which extends at a slight angle from being perpendicular to the shaft so as to maintain the head in the proper putting position tilted slightly from the vertical position. The detent 18 fits snugly within a recess 19 (FIG. 3) in the top of the club head such that the head is secured tightly to the shaft when the detent is seated therein.

For holding the detent within the seat 19 there is fixed a stub shaft 20 to the bottom of this detent at the center of rotation thereof relative to the club head. This stub shaft is of a proper diameter to fit snugly through an opening 22 in the club head connecting with an opening 25 extending from the bottom surface of the club head. The stub shaft extends vertically downward to a position adjacent the bottom surface 11A of the club head 11.

The well 25 extends from the bottom of the club head and preferably is centered on the opening 22 and connects therewith. Thus the assembly 15 is mounted on the club head 11 by insertion of the stub shaft 20 through the opening 22. For spring loading the club head against rotation relative to the shaft 12, the detent 18 is maintained in the recess 19. For this purpose a spring 26 having an inside diameter slightly greater than the outside diameter of the stub shaft 20 and an outside diameter slightly smaller than the diameter of the well 25 is inserted in the well around the stub shaft. Thereafter a locking pin 27 having an enlarged head 28 is inserted into a center opening 29 in the bottom of the stub shaft 20. This locking pin is fixed either by gluing or by a friction fit in this center opening.

In this manner, the spring 26 is compressed between the shoulder 29 and the locking pin head 28 so as to exert a downward force on the stub shaft 20 tending to hold the detent 18 in the recess 19. However by grasping the putter head 11 and the shaft 12 and pulling them in opposite directions, the spring 26 can be compressed sufficiently to move the detent from the recess to the dotted line position 30 shown in FIG. 2, for allowing rotation of the head relative to the shaft in the manner shown in FIG. 3. Thereafter the head can be positioned relative to the shaft to place either the face 14 or the face 16 in position to strike the ball. While there has been described a putting and pitching club, other types of hitting surfaces can be incorporated on the club head with equally beneficial results.

In accordance with another feature of the invention, the side walls 19A and 19B of the recess 19 are tapered outward at an angle of approximately three degrees from a line perpendicular to the bottom surface 19B of the recess. The side walls 18A of the detent are similarly cut at an angle so the detent acts as a wedge fitting into the complementary-shaped recess under force of the spring 26. In this manner the putting head 11 is always maintained in tight engagement with the detent and shaft.

The invention claimed is:

1. An adjustable golf club comprising in combination:

a shaft having a rigidly-connected substantially right angularly disposed planar member attached thereto at one end, said planar member extending in at least two directions from the shaft;

a head having a top surface forming a recess sized to receive said planar member with the top surfaces substantially coinciding with the same plane and align said shaft with the head for hitting a golf ball;

a stub shaft rigidly fixed to the surface of the planar member opposite the shaft such that when the planar member is positioned to fit into the recess, said stub shaft extends substantially normal to said planar member at a position intermediate the planar member ends;

said head including a well opening into said recess and positioned to receive said stub shaft when the planar member is seated in the recess;

means to lock and spring-load said stub shaft in said well to spring-load said planar member in said recess; and said head having surfaces on two sides configured to strike the ball whereby by moving the head relative to said shaft to unseat the planar member from the recess, the head can be rotated one hundred eighty degrees and the planar member repositioned in the recess to allow hitting the ball with either surface.

2. An adjustable golf club as defined in claim 1 wherein the hitting surfaces are positioned on opposite sides of the head.

3. An adjustable golf club as defined in claim 2 wherein said planar member is symmetrical about the elongated axis of the stub shaft.

4. An adjustable golf club as defined in claim 3 wherein said well includes a shoulder and said means to lock and spring-load said stub shaft in said well includes a spring positioned in compression between the shoulder and said stub shaft.

5. An adjustable golf club as defined in claim 1 wherein the planar member is wedge-shaped and the recess has a complementary configuration to maintain the shaft and head in tight engagement.

6. An adjustable golf club as defined in claim 4 including a sleeve fixed to said planar member and forming a center opening for receiving said shaft.

7. An adjustable golf club as defined in claim 5 wherein one head surface extends substantially perpendicular to the plane of said shaft for putting the golf ball and the other surface is positioned to provide lift on the hit ball.

* * * * *